US009605526B2

(12) United States Patent
Samuel et al.

(10) Patent No.: US 9,605,526 B2
(45) Date of Patent: Mar. 28, 2017

(54) FRICTION AND WEAR REDUCTION OF DOWNHOLE TUBULARS USING GRAPHENE

(71) Applicant: HALLIBURTON ENERGY SERVICES, INC., Houston, TX (US)

(72) Inventors: Robello Samuel, Cypress, TX (US); Aniket, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 237 days.

(21) Appl. No.: 14/382,408

(22) PCT Filed: Nov. 21, 2013

(86) PCT No.: PCT/US2013/071317

§ 371 (c)(1),
(2) Date: Sep. 2, 2014

(87) PCT Pub. No.: WO2015/076813

PCT Pub. Date: May 28, 2015

(65) Prior Publication Data

US 2016/0230528 A1 Aug. 11, 2016

(51) Int. Cl.
*E21B 12/02* (2006.01)
*E21B 17/00* (2006.01)
(Continued)

(52) U.S. Cl.
CPC ..... *E21B 44/00* (2013.01); *E21B 12/02* (2013.01); *E21B 17/006* (2013.01); *E21B 21/14* (2013.01); *E21B 41/00* (2013.01)

(58) Field of Classification Search
CPC .... E21B 17/1085; E21B 12/02; E21B 17/006; E21B 17/1007; E21B 41/02;
(Continued)

(56) References Cited

U.S. PATENT DOCUMENTS 7,052,736 B2 5/2006 Wei et al.
8,096,353 B2 1/2012 Ver Meer
(Continued)

FOREIGN PATENT DOCUMENTS

CN 101680278 A 3/2010
WO 2013-060847 A1 5/2013

OTHER PUBLICATIONS

International Search Report and Written Opinion of the International Searching Authority issued in International Application No. PCT/US2013/071317 on Aug. 14, 2014; 10 pages.

*Primary Examiner* — Daniel P Stephenson
(74) *Attorney, Agent, or Firm* — Alan Bryson; Parker Justiss, P.C.

(57) ABSTRACT

The subject matter of this specification is directed to a method that includes providing an outer tubular member having a bore with an inner surface, applying a lubricant layer to at least a portion of the inner surface of the outer tubular member, and positioning the outer tubular member in at least a portion of the wellbore. During the drilling process, mechanical wear between the outer and inner members can be measured by an indicator to determine if the measured indicator exceeds a predetermined threshold level.

20 Claims, 3 Drawing Sheets

(51) Int. Cl.
*E21B 44/00* (2006.01)
*E21B 21/14* (2006.01)
*E21B 41/00* (2006.01)

(58) Field of Classification Search
CPC ..... E21B 44/00; E21B 21/14; C09K 2208/10; C23C 14/0605; C23C 16/26
See application file for complete search history.

(56) References Cited

U.S. PATENT DOCUMENTS 8,183,180 B2 5/2012 Tour et al.
8,261,841 B2 9/2012 Bailey et al.
8,431,192 B2 4/2013 Wiese et al.
8,561,707 B2 * 10/2013 Jin ..... C23C 14/024 166/242.4
9,085,942 B2 * 7/2015 Hashem ..... E21B 17/1085
2003/0075340 A1 4/2003 Tran et al.
2005/0092527 A1 * 5/2005 Le ..... E21B 17/1007 175/325.6
2008/0035334 A1 2/2008 Newman
2009/0038858 A1 2/2009 Griffo et al.
2011/0203791 A1 8/2011 Jin et al.
2011/0220415 A1 * 9/2011 Jin ..... C23C 14/024 175/57
2011/0265918 A1 11/2011 Fujita et al.
2011/0272139 A1 11/2011 Van Den Brekel et al.
2012/0018141 A1 1/2012 John
2012/0024632 A1 2/2012 John
2012/0102843 A1 5/2012 Chakraborty et al.
2012/0199357 A1 8/2012 Seth et al.
2012/0245058 A1 9/2012 Monteiro et al.
2013/0277112 A1 10/2013 Edbury et al.
2014/0311528 A1 * 10/2014 Hallundbæk ..... C09K 8/54 134/22.12
2015/0176401 A1 * 6/2015 Samuel ..... E21B 44/00 702/6
2015/0337599 A1 * 11/2015 Bullock ..... E21B 33/085 175/24
2016/0230528 A1 * 8/2016 Samuel ..... E21B 12/02

* cited by examiner

FRICTION AND WEAR REDUCTION OF DOWNHOLE TUBULARS USING GRAPHENE

CLAIM OF PRIORITY

This application is a U.S. National Stage of International Application No. PCT/US2013/071317, filed Nov. 21, 2013.

TECHNICAL FIELD

This document generally describes friction and wear reduction techniques for equipment positionable in a wellbore, more particularly friction and wear reduction techniques using graphene as a lubricant.

BACKGROUND

In connection with the recovery of hydrocarbons from the earth, wellbores are generally drilled using a variety of different methods and equipment. According to one common method, a roller cone bit or fixed cutter bit is rotated against the subsurface formation to form the wellbore. The drill bit is rotated in the wellbore through the rotation of a drill string attached to the drill bit and/or by the rotary force imparted to the drill bit by a subsurface drilling motor powered by the flow of drilling fluid down the drill string and through downhole motor.

Frequently, as a well is being drilled, a string of coupled casing is run into the open-hole portion of the well bore and cemented in place by circulating cement slurry in the annulus between the exterior of the casing string and the wall of the wellbore. This is done by methods known in the art and for drilling purposes known in the art. Then the wellbore is drilled deeper. When drilling deeper, the rotating drill string is run through the interior of the casing string with the bit on the bottom of the drill string. The drill string comprises drill pipe joints joined together at tool joints (i.e. thread connections) and is rotated by the drilling rig at the surface. As the drill string is rotated the drill pipe, and more particularly the larger outside diameter portion of the tool joints may rub against the interior wall of the casing.

Rotating drill strings, like all moving mechanisms, exhibit friction that can result in mechanical wear of either or both the casing and the drill string. Friction and mechanical wear can cause drilling inefficiencies, due to increased power needed to overcome frictional resistance or due to maintenance or repair of assemblies due to wear.

DETAILED DESCRIPTION

Figure 1:
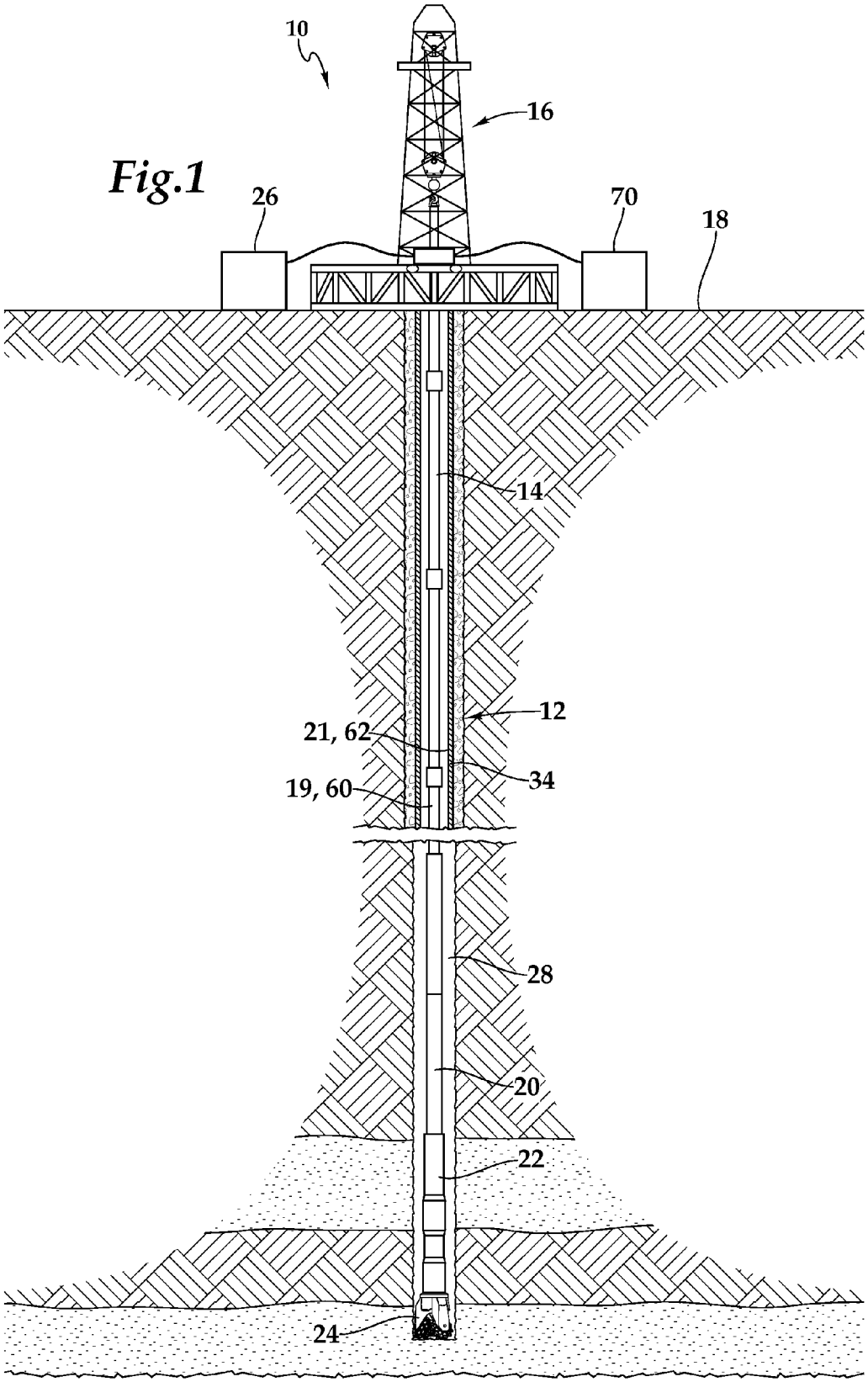
FIG. 1 is a diagram of an example drilling rig for drilling a wellbore.

FIG. 1 is a diagram of an example drilling rig 10 for drilling a wellbore 12. The drilling rig 10 includes a drill string 14 supported by a derrick 16 positioned generally on an earth surface 18. The wellbore 12 is at least partly lined by a casing 34. The drill string 14 extends from the derrick 16 into the wellbore 12 through a bore in the casing 34. The lower end portion of the drill string 14 includes at least one drill collar 20, and in some implementations includes a subsurface drilling fluid-powered motor 22, and a drill bit 24. The drill bit 24 can be a fixed cutter bit, a roller cone bit, or any other type of bit suitable for drilling a wellbore. A drilling fluid supply system 26 circulates drilling fluid (often called "drilling mud") down through a bore of the drill string 14 for discharge through or near the drill bit 24 to assist in the drilling operations. The drilling fluid then flows back toward the surface 18 through an annulus 28 formed between the wellbore 12 and the drill string 14. The wellbore 12 can be drilled by rotating the drill string 14, and therefore the drill bit 24, using a rotary table or top drive, and/or by rotating the drill bit with rotary power supplied to the subsurface motor 22 by the circulating drilling fluid.

To reduce the amount of friction between the drill sting 14 and the casing 34, a lubricant layer 60 is applied to the outer surface 19 of the drill string 14, and a lubricant layer 62 is applied to an inner surface 21 of the bore of the casing 34. In some embodiments, the lubricant layers 60, 62 can be layers of graphene.

In some embodiments, graphene can be applied to the inner surface 21 of the casing 34 and the outer surface 19 of the drill string 14 to form the lubricant layers 60, 62. For example, graphene in a powdered form may be sprinkled, blasted, power coated, or otherwise applied to the casing 34 and the drill string 14. In another example, the casing 34 and the drill string 14 may be contacted (e.g., rubbed) with solid graphite to leave behind graphene layer as the lubricant layers 60, 62. In some embodiments, graphene can be suspended in a liquid (e.g., ethanol) to form a graphene suspension, and the suspension can be sprayed onto the inner surface of the casing 34 and the outer surface 19 of the drill string 14 to form the lubricant layers 60, 62. For example, the graphene suspension may be sprayed using commercially available air-powered or airless sprayers.

In some implementations, commercially available solution processed graphene (SPG) containing graphene monolayer flakes dispersed in ethanol having a weight concentration of graphene as 1 mg/L can be used on the inner walls of the casing 34, liners and risers, and/or on the outer surface 19 of the drill string 14 at the start of a drilling operation. SPG can be sprayed or sprinkled on the intended steel surfaces using any appropriate commercially available spraying or sprinkling systems.

In some implementations, graphene can provide improved tribological properties, and the application of graphene on contacting downhole surfaces can reduce friction and wear. In some implementations, the contact between the casing 34 and the drill string 14 downhole can wear out lubricant layers 60, 62, and replenishment of the lubricant coatings, e.g., graphene, may be provided. The lubricant layers 60, 62 can be reapplied by sprinkling solution-processed graphene on drill pipes, drill collars, the bottom hole assembly, or other downhole tools when they are tripped out of the wellbore 12 so that a fresh coating can be established. In some implementations, solution processed graphene can be added on a continuous basis to the circulating drilling fluid to help replenish the worn out graphene coatings downhole.

In some implementations, the application of a protective graphene layer can reduce the coefficient of friction during rotary operations, as well as reduce the sliding friction during tripping or during sliding drilling. In some implementations, the application of protective graphene layers can also reduce the wear on the inner surface 21 of the casing 34, wear on the drill string 14, as well as the mechanical wear of bottom hole assembly tools during drilling operations. In some implementations, application of graphene can improve the wellbore integrity and the life of downhole tools/tubulars, e.g., measurement-while-drilling tools, logging while drilling tools, stabilizer blades, connection subs, bits, teeth, rotary steerable systems, drill pipes, heavy weight drill pipes, drill collars.

A monitor 70 measures an indicator of mechanical wear between the drill string 14 and the casing 34. In some implementations, the monitor 70 can measure a concentration of one or more predetermined materials suspended in the drilling fluid and corresponding to at least one of the drill string 14 and the casing 34. For example, the drill string 14 and the casing 34 may be constructed of known materials (e.g., steel, iron, aluminum, ceramic), and the monitor 70 may be configured to detect and measure amounts of the known materials worn off from the downhole components and suspended in drilling fluid that flows to the surface from downhole. The concentrations of such known materials may be measured over time to estimate an amount of wear that has occurred along the drill string 14 and the casing 34.

In some implementations, the monitor 70 can measure an amount of torque developed between the drill string 14 and the casing 34. For example, the amount of torque developed between the drill string 14 and the casing 34 may be used to estimate the amount of wear that has occurred along the drill string 14 and the casing 34 and/or estimate the downhole friction acting between them.

In some implementations, the monitor 70 can indicate one or more mechanical dimensions of the drill string 14 and/or the casing 34. For example, the drill string 14 may start its service life with an initial outer diameter that gradually shrinks as friction and mechanical wear erode away the outer surfaces of the drill string 14. In another example, the casing 34 may start its service life with an initial inner diameter that gradually grows as friction and mechanical wear erode away the inner surface of the casing 34. The monitor 70 may be configured to measure these and/or other mechanical dimensions of the drill string 14 and/or the casing 34 to determine an amount of wear that has occurred along the drill string 14 and/or the casing 34.

In some example drilling operations, the casing 34, liners, or risers can run in the wellbore 12 according to a drilling program. The drill string 14 can be tripped in to the wellbore 12 to drill the well. The downhole wear in casings can be monitored by the monitor 70 by running in logs (e.g., ultrasonic imager log, caliper log) to measure the inside diameter of the casing 14. Based on the log readings, percent of casing wear volume can be estimated using wear models. In some examples, if the percent of casing wear volume is more than a tolerance amount, e.g., 20%, then steps to mitigate this wear can be taken. Such steps may involve adding commercially available SPG to the circulating drilling fluid so that it can replenish the lubricating layers 60, 62. However, in examples in which the drilling program permits, the drill string 14 can be tripped out to reapply SPG on the outer surface 19 to further mitigate wear.

In some implementations, casing wear can be monitored or estimated by inspecting the drilling fluid for steel shavings, visually or using any other appropriate inspection technique. For example, collected steel shavings can be used to estimate the casing wear volume, and if beyond tolerance, then mitigation steps can be taken. In such examples, if the application of SPG does not show any improvement in downhole casing wear, then the concentration of graphene in the SPG solution can be increased.

Figure 2:
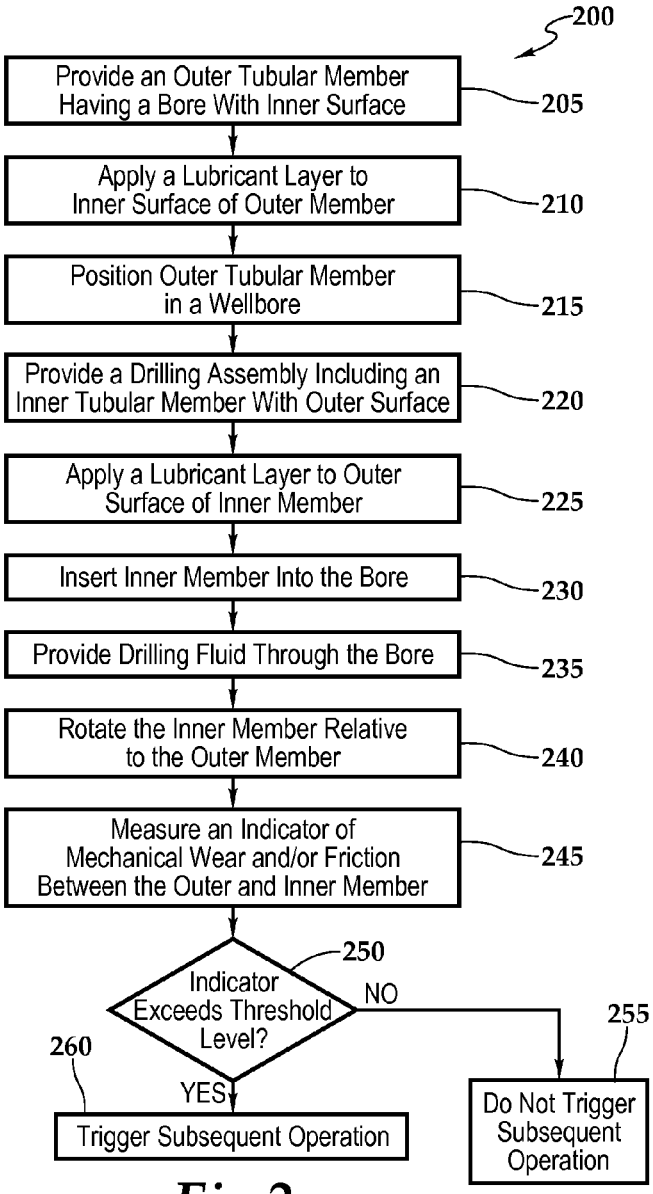
FIG. 2 is a flow diagram of an example process for a friction and wear reduction technique for downhole tools disposed in a wellbore.

FIG. 2 is a flow diagram of an example process 200 for a friction and wear reduction technique for downhole tools disposed in a wellbore, such as those discussed in the descriptions of FIG. 1. Though depicted sequentially as a matter of convenience, at least some of the actions shown can be performed in a different order and/or performed in parallel. Additionally, some embodiments may perform only some of the actions shown. In some embodiments, the operations of FIG. 2, as well as other operations described herein, can be implemented as instructions stored in a computer-readable storage medium and executed by a processor.

The process 200 starts by providing an outer tubular member having a bore with an inner surface (block 205). For example, the casing 34 of FIG. 1 has the inner surface 21 along the bore. A first lubricant layer is applied to at least a portion of the inner surface of the outer tubular member (block 210). For example, a layer of graphene can be applied (e.g., sprayed, sprinkled, rubbed) onto the inner surface 21 as the layer 62. The outer tubular member is then positioned in at least a portion of the wellbore (block 215). For example, the casing 34 can be placed in the wellbore 12.

The process 200 continues by providing a drilling assembly including an inner member having an outer surface, said inner member having a central longitudinal axis aligned with a central longitudinal axis of the outer member (block 220). For example, the drill string 14 may be provided, and the drill string 14 has the outer surface 19. A second lubricant layer is applied to at least a portion of the outer surface of the inner member (block 225), and the inner member is inserted into the bore of the outer tubular member (block 230). For example, a layer of graphene can be applied (e.g., sprayed, sprinkled, rubbed) onto the outer surface 19 as the lubricant layer 60, and then the drill string 19 can be inserted into the bore of the casing 34.

A drilling fluid is provided through the bore of the drilling assembly (block 235). For example, drilling fluid can be circulated through the bore of the drill string and returned back to the surface through the annulus between the drill string and the casing in a conventional drilling operation in block 235.

An indicator of at least one of mechanical wear and friction between the outer member and the inner member is measured (block 245). For example, the monitor 70 can be used to measure an indicator of mechanical wear between the drill string 14 and the casing 34. If the measured indicator is determined (block 250) to have not exceeded a predetermined threshold level, then a subsequent action is not triggered in response to the determining (block 255). If the measured indicator is determined (block 250) to have exceeded the predetermined threshold level, then a subsequent operation is triggered in response to determining that the measured indicator exceeds the predetermined threshold level (block 260).

In some embodiments, the measured indicator can be a concentration of one or more predetermined materials suspended in the drilling fluid and corresponding to at least one of the outer member and the inner member. For example, as the drill string 14 and the casing 34 wear, some of the material used to construct the drill string 14 and the casing 34 may be worn off and enter the drilling fluid. In some examples, the worn material may be suspended in the drilling fluid. In some examples, the worn material may mix with the drilling fluid. In some examples, the worn material may interact chemically with one or more compounds or elements of the drilling fluid. As the drilling fluid recirculates back to the surface, the worn material or evidence of it is carried to the surface as well. In some embodiments, the monitor 70 can be configured to detect the worn material or evidence of it, for example, using a magnetometer, a spectrometer, reagent testing, or any other appropriate technique for detecting materials carried by the drilling fluid. In some implementations, when a predetermined amount of material is detected in the drilling fluid, a subsequent operation may be triggered. For example, graphene may be added to drilling fluid or graphene may be re-applied to the drill string 14 by tripping it out.

In some embodiments, the measured indicator can be a measured amount of torque developed between the inner member and the outer member. For example, the monitor 70 can measure the amount of torque that is developed between the drill string 14 and the casing 34. The measured torque can be used to determine an amount of friction between the drill string 14 and the casing 34 and/or can be used as an indicator of the amount of wear for the drill string 14 and the casing 34. In some implementations, when a predetermined amount of torque is measured, a subsequent operation may be triggered. For example, graphene may be added to drilling fluid or graphene may be re-applied to the drill string 14 by tripping it out.

In some embodiments, the measured indicator can be one or more mechanical dimensions of at least one of the outer member and the inner member. For example, the monitor 70 or a human operator can use a caliper, gauge, or other appropriate device to measure the physical dimensions of the inner surface 21 of the casing 34 and/or the outer surface 19 of the drill string 14. In operation, as the drill string 14 and the casing 34 wear, the dimensions of the inner surface 21 may generally increase (e.g., the bore within the casing 34 may gradually get larger) and/or the dimensions of the outer surface 19 may decrease (e.g., the drill string 14 may erode). In some implementations, when a predetermined amount of wear is detected, a subsequent operation may be triggered. For example, graphene may be added to drilling fluid or graphene may be re-applied to the drill string 14 by tripping it out.

In some implementations, drilling parameters such as torque, hook load, and weight-on-bit can be monitored to estimate the downhole friction acting on the drill string. If, for example, the drill string experiences 20% higher torque than normal during the drilling activity, steps to mitigate the downhole friction should be taken. The steps to reduce friction, as described above, can include adding SPG to the circulating drilling fluid or if applicable in the drilling program, tripping out the drill string to reapply SPG on the outer surfaces. In another example, if the drilling rig is working near its rated torque capacity, then the drill string can be tripped out to reapply SPG on its outer walls.

Another example method to monitor downhole friction can include estimating the friction factor using appropriate models. For example, a friction factor of higher than 0.5 in the cased hole section may suggest that the drill string should be tripped out to reapply SPG. Even higher values of friction factors, e.g., 0.8 or 0.9, can be addressed by using relatively higher concentrations of graphene in the SPG solution. If selected concentrations of graphene used in SPG do not help mitigate downhole friction, the concentration of graphene in SPG can be further increased.

In various implementations, the wear on the drill string 14, including the drill pipe body, tool joints and the any other component in the bottom hole assembly, can be monitored by inspecting visually, or by using any other appropriate inspection technique, to analyze the wear on the drill string 14 when it is tripped out during drilling operations. In some implementations, measuring the wall thickness of the drill pipe or any component in the bottom hole assembly can be one of the techniques used to determine the wear in the drill string 14. For example, a 5% or greater reduction in wall thickness may indicate a need for reapplication of SPG on the outer surface 19. Additionally, areas on the drill string that display shine and wear due to downhole friction may be selected for reapplication of SPG solution to replenish the worn away layers of graphene to mitigate friction.

Figure 3:
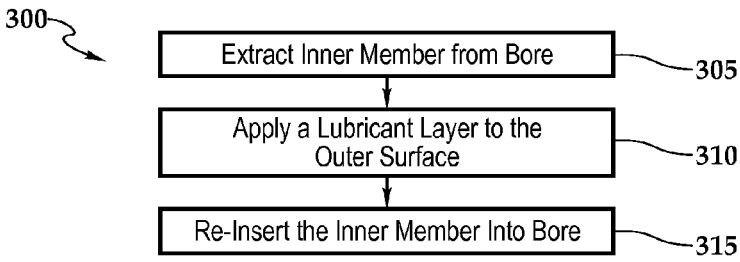
FIG. 3 is a flow diagram of an example subsequent operation for friction and wear reduction techniques for downhole tools disposed in a wellbore.

FIG. 3 is a flow diagram of an example subsequent operation 300 for friction and wear reduction techniques for downhole tools disposed in a wellbore. In some implementations, the subsequent operation 300 may be the subsequent operation triggered in block 260 of FIG. 2.

The operation 300 starts by extracting the inner member from the bore (block 305). For example, the drill string 14 of FIG. 1 can be extracted from the casing 34. A lubricant layer is then applied to the outer surface (block 310) and the inner member is re-inserted into the bore. For example a layer of graphene can be re-applied (e.g., sprayed, sprinkled, rubbed) onto the outer surface 19, and then the drill string 14 can be re-inserted into the casing 34.

In another implementation, the subsequent operation triggered in block 360 of FIG. 2 can include increasing a concentration of graphene suspended in the drilling fluid. For example, when the monitor 70 determines that indications of friction or wear have exceeded a predetermined threshold, the monitor 70 can transmit a signal as an indicator to additional equipment or human operators that one or more lubricants, such as graphene, should be added to the drilling fluid being pumped downhole to carry the lubricant to the inner surface 21 and/or the outer surfaces 19.

Figure 4:
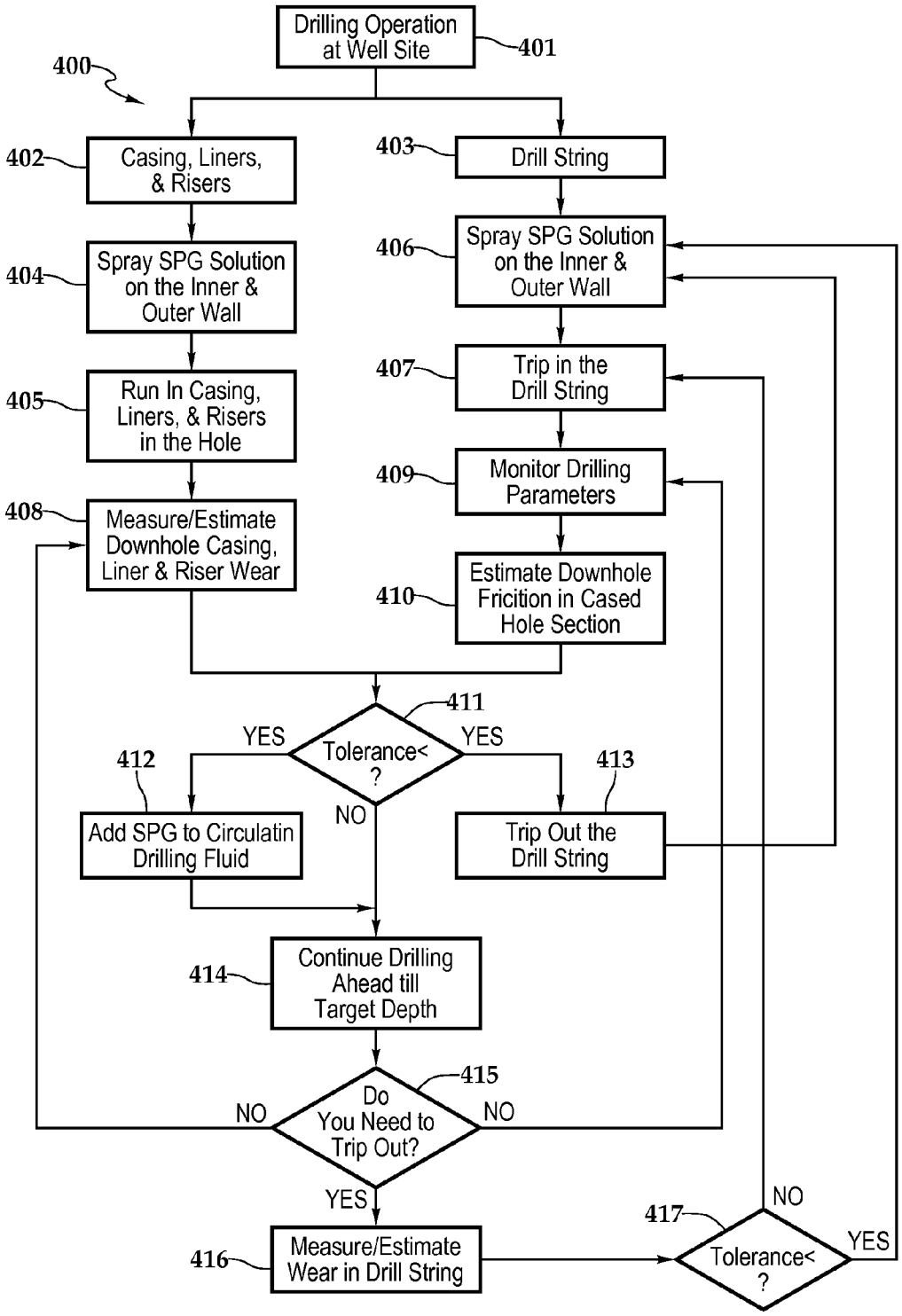
FIG. 4 is a flow diagram of an example process for the application of lubricant for downhole tools.

FIG. 4 is a flow diagram of an example process 400 for the application of lubricant for downhole tools, such as those described in FIG. 1. Graphene monolayer flakes dispersed in ethanol can be applied on steel surfaces by spraying or sprinkling SPG on the intended steel surfaces using any appropriate commercially available spraying or sprinkling systems. Application of this graphene-containing ethanol solution on the steel surfaces, and further evaporation of the liquid ethanol part, leaves behind few layers of graphene on the steel surfaces. In some implementations, reapplication of spraying SPG can be done based on field measurements and/or estimation of downhole friction and wear parameters as explained in the description of the process 400 below.

The process 400 starts in block 401 during the drilling of any appropriate oil or gas well at a well site. Lubricant layers of graphene can be applied to the tubulars used during the drilling operation, e.g., casings, liners, risers and the drill string including the bottom hole apparatus (BHA). At block 402, casings, liners, and risers are used in any appropriate drilling operation and can experience contact with the drill string on their inner walls. At block 404, SPG is sprayed on the inner as well as outer walls of the casings, liners and risers that are run in for drilling the well. Inner walls may have contact with the outer body of the drill string during the drilling operation, and as such graphene may be used to reduce wear and friction. Outer walls may have contact with the inner walls of the previously run in casings, liners, and risers in the well when a new set is being run in to be installed. In such example situations, graphene can help reduce friction and wear between the outer body of the casing run in and the inner body of the previously installed casing.

The casings, liners, and risers are run into the hole after application of SPG solution on the inner and outer was at block 405. At block 408, the downhole casing, liner, and riser wear are measured or estimated using calipers or other techniques as practiced in the industry.

At block 411 the measured and estimated values of downhole friction and wear are compared with predetermined tolerance limits set for the operation. If the predetermined tolerance limits have not been exceeded, then the drilling operation continues at block 414, e.g., until the target depth is reached. If the predetermined tolerance limits have been reached at block 411, then SPG can be added to the circulating drilling fluid to replenish the graphene layers that have worn out due to downhole contact. After addition of the SPG, drilling can continue at block 414 until the target depth. Further monitoring of friction and wear can be done to determine the effectiveness of adding SPG. In some implementations, if the predetermined tolerance limits have been reached at block 411, then the drill string can be tripped out at block 413 in order to replenish the graphene layers that have been worn out due to downhole contact. After tripping out, SPG can be sprayed again on the outer walls of the drill string to replenish the graphene layers in block 406. The drill string can be subsequently tripped in to continue with the drilling operation in block 407. In some implementations, the operations of blocks 412 and 413 can be followed separately or together to reduce the downhole friction and wear.

If tripping out is required as a part of the drilling operation at block 415, for example to change the bit or BHA or due to any other operational reason, the wear on the drill string is measured or estimated at block 416. If tripping out of the drill string is not required at block 415, then additional monitoring of the drilling parameters and wear is done while continuing to drill ahead to the target depth.

Referring now to block 403, the drill string including the BHA is used in any appropriate drilling operation to reach the target depth. The outer wall of the drill string can experience contact with the inner wall of the casings, liners, and risers during the drilling operation. To reduce friction and wear due to such contact, at block 406 SPG is sprayed on the outer wall of the drill string including the BHA before tripping it in the wellbore at block 407.

As drilling operations progress toward the target depth, the drilling parameters are monitored at block 409 to determine if the efficiency of the drilling operation may be improved and/or downhole friction and wear may be reduced, by taking further steps to lubricate surfaces of the drill string. At block 410, the downhole friction experienced in the riser and the cased hole section (e.g., due to contact with the outer wall of the drill string) is estimated using techniques known in the industry.

At block 411 the measured and estimated values of downhole friction and wear are compared with predetermined tolerance limits set for the operation. If the predetermined tolerance limits have not been exceeded, then the drilling operation continues at block 414. If the predetermined tolerance limits have been reached at block 411, then the drill string is tripped out at block 413 in order to replenish the graphene layers that have been worn out due to downhole contact. After tripping out, SPG is sprayed again on the outer walls of the drill string to replenish the graphene layers in block 406. The drill string is subsequently tripped in to continue with the drilling operation in block 407. In some implementations, if the predetermined tolerance limits have been reached at block 411, then SPG can be added to the circulating drilling fluid to replenish the graphene layers that have worn out due to downhole contact. After addition of the SPG, drilling can continue at block 414 until the target depth. In some implementations, the operations of blocks 412 and 413 can be followed separately or together to reduce the downhole friction and wear.

If at block 415, it is determined that the drill string does not need to be tripped out, then the drilling parameters are monitored again at block 409. If at block 415, it is determined that the drill string does need to be tripped out, then the wear on the drill string is measured or estimated at block 416. If at block 417 the measured wear on the drill string is determined to be higher than predetermined tolerance limits, then SPG is sprayed on the outer walls of the drill string at block 406 to replenish the worn out graphene layers. If the measured wear is within the predetermined tolerance limits, then the drill string is tripped back in at block 407 to continue the drill operation, e.g., to reach the target depth.

Although a few implementations have been described in detail above, other modifications are possible. For example, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A method of reducing friction of a drilling equipment positionable in a wellbore, said method comprising:

providing an outer tubular member having a bore with an inner surface;

applying a first lubricant layer to at least a portion of the inner surface of the outer tubular member;

positioning the outer tubular member in at least a portion of the wellbore;

providing a drilling assembly including an inner member having an outer surface, said inner member having a central longitudinal axis aligned with a central longitudinal axis of the outer member;

applying a second lubricant layer to at least a portion of the outer surface of the inner member;

inserting the inner member into the bore of the outer tubular member;

providing a drilling fluid through the bore of the drilling assembly;

rotating the inner member relative to the outer member;

measuring an indicator of at least one of mechanical wear and friction between the outer member and the inner member;

determining that the measured indicator exceeds a predetermined threshold level; and triggering a subsequent operation in response to determining that the measured indicator exceeds the predetermined threshold level, wherein the subsequent operation comprises increasing a concentration of graphene suspended in the drilling fluid.

2. The method of claim 1, wherein at least one of the first lubricant layer and the second lubricant layer comprise graphene.

3. The method of claim 1, wherein the outer tubular member is a tubular casing, liner, or riser and the inner member is a drilling tubular or a drilling tool.

4. The method of claim 1, wherein the indicator is a concentration of one or more predetermined materials suspended in the drilling fluid and corresponding to at least one of the outer tubular member and the inner member.

5. The method of claim 1, wherein the indicator indicates an amount of torque developed between the inner member and the outer tubular member.

6. The method of claim 1, wherein the indicator indicates one or more mechanical dimensions of at least one of the outer tubular member and the inner member.

7. The method of claim 1, wherein the subsequent operation causes the measured indicator to fall below the predetermined threshold level.

8. The method of claim 7, wherein the subsequent operation comprises:

extracting the inner member from the bore;

applying a third lubricant layer to the outer surface; and re-inserting the inner member into the bore.

9. The method of claim 1, wherein at least one of applying a first lubricant layer to the inner surface and applying a second lubricant layer to the outer surface comprises:

suspending graphene in a liquid to form a graphene suspension; and applying the suspension to at least one of the inner surface and the outer surface.

10. The method of claim 1, wherein at least one of applying a first lubricant layer to the inner surface and applying a second lubricant layer to the outer surface comprises:

applying graphene to at least one of the inner surface and the outer surface.

11. A system for reducing friction of a drill string positionable in a wellbore, said wellbore comprising at least a portion of an outer tubular member having a bore with an inner surface and a first lubricant layer applied to at least a portion of the inner surface of the outer tubular member; said system comprising:

a drilling assembly including:

an inner member having an outer surface and a second lubricant layer on the outer surface, said inner member having a central longitudinal axis aligned with a central longitudinal axis of the outer member and said inner member being insertable within the bore of the outer member;

a mechanical wear monitor configured to perform operations comprising:

measuring an indicator of at least one of mechanical wear and friction between the outer member and the inner member;

determining that the measured indicator exceeds a predetermined threshold level; and triggering a subsequent operation in response to determining that the measured indicator exceeds the predetermined threshold level, wherein the subsequent operation comprises increasing a concentration of graphene suspended in a drilling fluid.

12. The system of claim 11, wherein at least one of the first lubricant layer and the second lubricant layer comprise graphene.

13. The system of claim 11, wherein the outer tubular member is a tubular casing, liner, or riser and the inner member is a drilling tubular or a drilling tool.

14. The system of claim 11, wherein the mechanical wear monitor comprises a sensor having an output that varies in response to a detected concentration of one or more predetermined materials suspended in a drilling fluid and corresponding to at least one of the outer member and the inner member, and wherein the indicator is based on the output.

15. The system of claim 11, wherein the mechanical wear monitor comprises a sensor having an output that varies in response to a detected amount of torque developed between the inner member and the outer member, and wherein the indicator is based on the output.

16. The system of claim 11, wherein the mechanical wear monitor comprises a sensor having an output that varies in response to a detected one or more mechanical dimensions of at least one of the outer member and the inner member, and wherein the indicator is based on the output.

17. The system of claim 11, wherein the subsequent operation causes the measured indicator to fall below the predetermined threshold level.

18. The system of claim 17, wherein the subsequent operation comprises:

extracting the inner member from the bore;

applying a third lubricant layer to the outer surface; and re-inserting the inner member into the bore.

19. The system of claim 11, wherein at least one of applying a first lubricant layer to the inner surface and applying a second lubricant layer to the outer surface comprises:

suspending graphene in a liquid to form a graphene suspension; and applying the suspension to at least one of the inner surface and the outer surface.

20. The system of claim 11, wherein at least one of applying a first lubricant layer to the inner surface and applying a second lubricant layer to the outer surface comprises:

applying graphene to at least one of the inner surface and the outer surface.

* * * * *